US006032630A

United States Patent [19]

Yamamoto et al.

[11] Patent Number: 6,032,630

[45] Date of Patent: Mar. 7, 2000

[54] VALVE LIFTER

[75] Inventors: Ken Yamamoto; Takashi Nozaki, both of Shizuoka, Japan

[73] Assignee: NTN Corporation, Osaka, Japan

[21] Appl. No.: 09/190,282

[22] Filed: Nov. 13, 1998

[30] Foreign Application Priority Data

| | | | |
|---|---|---|---|
| Nov. 17, 1997 | [JP] | Japan | 9-315280 |
| Nov. 17, 1997 | [JP] | Japan | 9-315348 |
| Nov. 17, 1997 | [JP] | Japan | 9-315365 |

[51] Int. Cl.[7] ..... F01L 1/14; F01L 1/22

[52] U.S. Cl. ..... 123/90.54; 123/90.19

[58] Field of Search ..... 123/90.19, 90.48, 123/90.49, 90.52, 90.53, 90.54; 74/569

[56] References Cited

U.S. PATENT DOCUMENTS

| | | | |
|---|---|---|---|
| 3,823,698 | 7/1974 | Van Deberg | 123/90.54 |
| 4,321,894 | 3/1982 | Black | 123/90.54 |
| 4,469,057 | 9/1984 | Black | 123/90.54 |
| 4,706,620 | 11/1987 | Gill | 123/90.54 |
| 4,981,117 | 1/1991 | McRobert et al. | 123/90.43 |
| 5,003,940 | 4/1991 | Hixson | 123/90.54 |

FOREIGN PATENT DOCUMENTS 3-8603 1/1991 Japan .

*Primary Examiner*—Weilun Lo

*Attorney, Agent, or Firm*—Wenderoth, Lind & Ponack, L.L.P.

[57] ABSTRACT

A direct valve drive device which can open and lose a valve with accuracy even if a negative valve clearance forms between the cam and the valve stem due to a difference in thermal expansion coefficient between the cylinder head made of aluminum alloy and the iron valve. A valve lifter is mounted between the cam and the valve stem being biased toward the cam by a valve spring. An adjuster bolt is threaded into a threaded hole formed in the valve lifter. The force of a spring is applied to the adjuster bolt so that the adjuster bolt move, while rotating, toward the valve stem. Formed between the threadedly engaging portions of the adjuster bolt and the threaded hole is an axial hole which is smaller than the height of a ramp formed on the cam but large enough to absorb any difference in thermal expansion between the cylinder head and the valve. Even if the valve clearance changes toward the negative side, the axial gap absorbs such a change, thus preventing the valve from being pushed by the base circle of the cam.

15 Claims, 6 Drawing Sheets

VALVE LIFTER

BACKGROUND OF THE INVENTION

This invention relates to a direct valve driving device for opening a valve by directly pushing it down with a rotating cam.

In a direct type valve driving mechanism, an intake or an exhaust valve is directly pushed down by a rotating cam. Such a direct type valve driving mechanism typically includes a valve lifter mounted between the cam and the top end of a valve stem. The force of a valve spring is applied to the valve stem to press the valve lifter against the cam. The valve stem can thus be pushed down by the cam through the valve lifter kept in contact with the cam.

A valve lifter of this type is disclosed in unexamined Japanese utility model publication 3-8603. This valve lifter has a nut member in abutment with the bottom surface of a closure end plate of a guide cap mounted between a cam and a valve. An engaging plate is mounted to the bottom end of an adjuster bolt threading into the nut member. The force of a return spring is applied to the engaging plate to apply torque in the protruding direction to the adjuster bolt, thereby keeping its bottom end pressed against the valve stem.

In a valve driving system with a valve lifter of this type, if a positive valve clearance forms between the cam and the valve lifter due to a difference in thermal expansion coefficient between the cylinder head, typically made of an aluminum alloy, and the iron valve, the adjuster bolt moves toward the valve stem while rotating under the force of the return spring, thus absorbing any change in the valve clearance. The valve can thus be opened and closed with extremely high reliability.

When the engine is cut at high temperature and cools down gradually, a negative valve clearance may form between the base circle of the cam and the valve lifter due to a difference in thermal expansion coefficient between the cylinder head and the valve. If this happens, the valve stem of the valve will be pushed by the base circle of the cam, thus opening the valve.

Ordinarily, an axial gap is present between the threads of the nut member and the adjuster bolt. If the axial gap is large enough, this gap serves to absorb any change in the valve clearance. But in conventional valve lifters, the size of the axial gap is not specified, so that the valve may open after the engine has been cut.

If the engine is started with its valves open, the pressure in the cylinders will not rise during the combustion stroke. It is thus desired to more accurately open and close valves.

In a direct valve driving device, the valve lifter is brought into contact with the cam by the force of the valve spring which is applied to the valve stem. Thus, while the intake or exhaust port is closed by the valve, the force of the valve spring is not applied to the valve lifter. Also, due to limited mounting space, the force of the valve spring is limited. Thus, a gap is formed between contact surfaces of the base circle of the cam and the valve lifter because the valve lifter cannot follow the rotation of the cam. Thus, the valve cannot be opened and closed with accuracy.

With a valve lifter, the adjuster bolt is threaded into the nut member abutting the bottom face of the closure end plate of the guide cap. The length from the cam contact surface of the guide cap to the bottom end of the adjuster bolt is thus long. The axial length of the valve driving device is thus long. That is, such a valve driving device is not compact enough.

Also, since the guide cap is lowered with the cam kept in contact with the closure end plate of the guide cap, the entire guide cap has to be made from a hard material. The nut member also has to be made from a hard material because it has to be wear-resistant. The entire weight is thus heavy. That is, the entire device is not lightweight enough.

An object of this invention is to provide a direct valve drive device which can open and close a valve with accuracy even if a negative valve clearance is present between the cam and the valve stem due to a difference in thermal expansion coefficient between the cylinder head made of aluminum alloy and the iron valve.

A second object of this invention is to provide a direct valve drive device which can drive a valve with accuracy.

A third object of this invention is to provide a compact and lightweight valve lifter which can drive a valve with accuracy.

SUMMARY OF THE INVENTION

According to the invention, there is provided a direct valve drive device comprising a cap-shaped valve lifter having a closed top and axially slidably mounted between a cam and a valve stem made of iron and slidably supported by a cylinder head made of an aluminum alloy, a valve spring biasing the valve stem in such a direction that the valve lifter is pressed against the cam, the valve lifter being formed with a threaded hole coaxial with the valve stem, and an adjuster bolt threaded into the threaded hole and spring-biased so as to be movable, while rotating, toward the valve stem, characterized in that an axial gap is formed between thread engagement portions of the threaded hole and the adjuster bolt, the axial gap being smaller than the height of a ramp formed on the cam but large enough to be able to absorb any difference in thermal expansion between the cylinder head and the valve.

With this arrangement, if a negative clearance is formed between the base circle of the cam and the valve lifter when the engine is stopped at a high temperature and cools down, such change in the valve clearance is absorbed by an axial gap formed between the threads of the threaded hole and the threads of the adjuster bolt. This prevents the valve from being left open.

In order to solve the second object, according to this invention, the valve lifter is pressed against the cam by the force of an elastic member.

The elastic member may be mounted between a spring retainer mounted on the top of the valve stem for bearing the force of the valve spring and the closed end of the valve lifter, or between a spring bearing surface formed on the cylinder head and the closed end of the valve lifter.

The elastic member may be a disk spring, a coil spring or a corrugated spring washer.

In order to solve the third object, according to this invention, the valve lifter comprises a cap-shaped lifter body made from an aluminum alloy and having a closed end formed with a nut mounting through hole, a nut member formed of a hard metal plate and nonrotatably received in the nut mounting hole, and a shim made of a hard metal and mounted on top of the lifter body.

The nut member may be made nonrotatable by serrations formed on the inner periphery of the nut mounting hole and the outer periphery of the nut member, by engaging a flange formed around the nut member in a recess formed in the nut member.

Other features and objects of the present invention will become apparent from the following description made with reference to the accompanying drawings, in which:

BRIEF DESCRIPTION OF THE PREFERRED EMBODIMENT

DETAILED DESCRIPTION OF THE PREFERRED EMBODIMENT

First Embodiment

Figure 1:
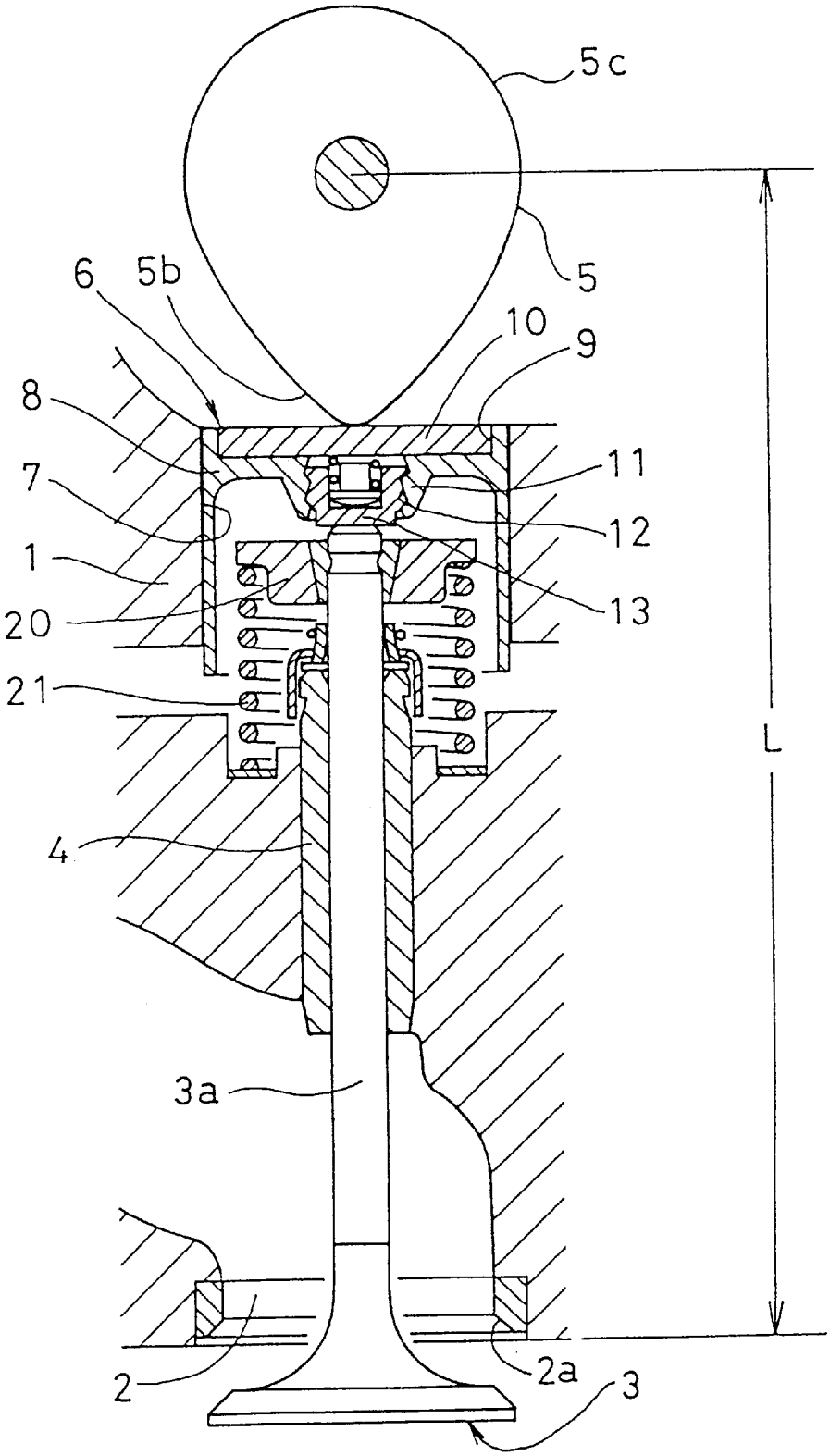
FIG. 1 is a front view in vertical section of a valve driving device embodying this invention.

FIG. 1 shows a valve driving system for opening and closing an intake port 2 formed in a cylinder head 1 made of aluminum alloy. An iron valve 3 for opening and closing the intake port 2 has a valve stem 3*a* axially slidably supported by a stem guide 4 secured to the cylinder head 1.

A valve lifter 6 is mounted between the valve stem 3*a* and a cam 5 thereover. The valve lifter 6 has the shape of a cap with a closed top and slidably fits in a guide hole 7 formed in the cylinder head 1.

The valve lifter 6 has a top plate 8 having a recess 9 in its top surface. A shim 10 made of a hard material is received in the recess 9.

Figure 2:
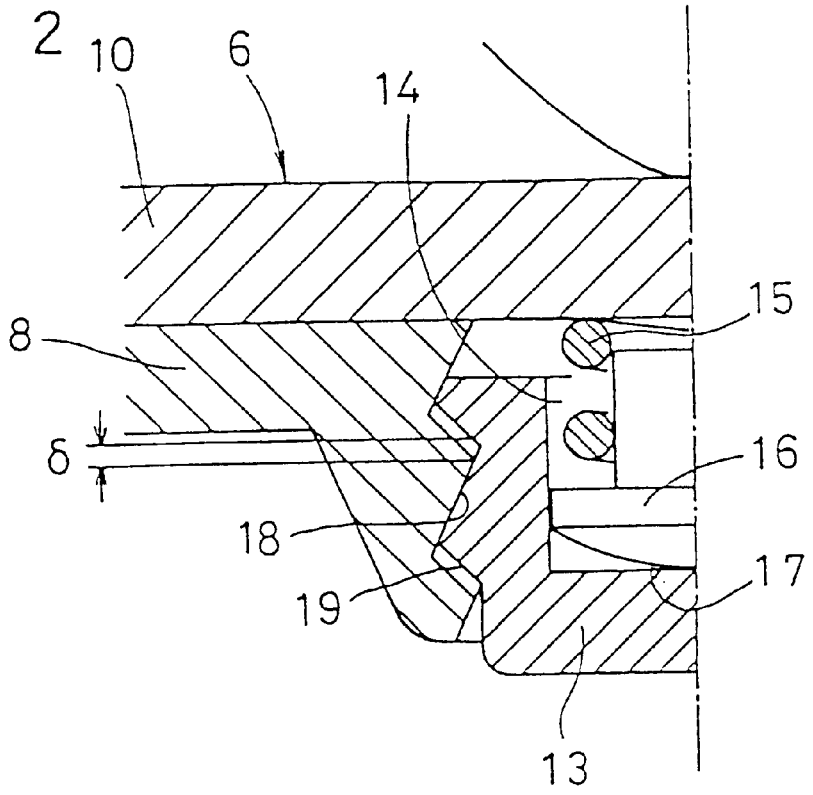
FIG. 2 is an enlarged sectional view of a valve lifter of the device of FIG. 1.

A protrusion 11 is formed on the bottom surface of the top plate 8. An adjuster bolt 13 threads into a threaded hole 12 formed in the protrusion 11. As shown in FIG. 2, the adjuster bolt 13 has an open-topped hole 14 in which are received a spring 15 and a spring seat 16. The spring seat 16 has a spherical bottom 17 kept in point contact with the bottom wall of the hole 14.

The spring seat 16 may be interposed between the spring 15 and the shim 10.

The threads of the threaded hole 12 and the adjuster bolt 13 are serration-shaped. That is, their pressure flanks 18 for bearing the axial pushing force applied to the adjuster bolt 13 from the valve stem 3*a* have a greater flank angle than their clearance flanks 19. The flank angles and the lead angle of the serration-shaped threads are determined such that the adjuster bolt 13 moves downward while rotating under the force of the spring 15. When a static pushing force is applied to the adjuster bolt 13 from the valve stem 3*a*, the pressure flanks bear such pushing force, keeping the bolt 13 from moving axially upwardly. When a dynamic pushing force is applied to the adjuster bolt 13 due to vibration of the valve spring 21 and this force exceeds the force of the spring 15, the bolt is adapted to be moved upwardly while rotating until the force of the spring 15 balances with the pushing force.

An axial gap δ is present between the threads of the threaded hole 12 and the adjuster bolt 13. This axial gap δ is smaller than the height of a ramp of the cam 5 but is large enough to absorb any difference in thermal expansion coefficient between the cylinder head 1 and the valve 3.

Figure 3:
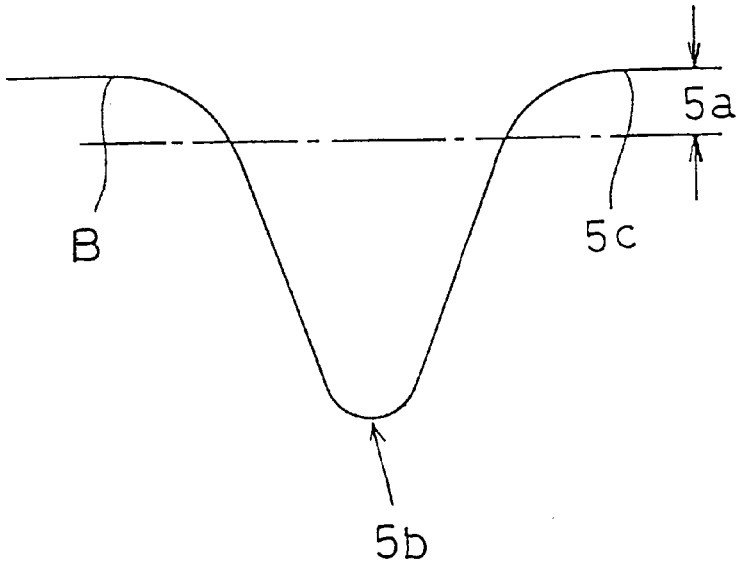
FIG. 3 is a curve showing the contour of the cam of FIG. 1.

As shown in FIG. 3, the ramp 5*a* of a cam lift curve B prevents impulsive collision of the valve 3 shown in FIG. 1 against the valve seat 2*a* of the intake port 2. It is about 0.5 mm high. Thus, the axial gap δ has to be less than 0.5 mm.

As shown in FIG. 1, a spring retainer 20 is secured to the top end of the valve stem 3*a*. The valve spring 21 provided under the retainer 20 biases the spring retainer 20 upwardly, thereby pressing the top end of the valve stem 3*a* against the bottom end of the adjuster bolt 13.

When the cam 5 rotates, its crest 5*b* pushes down the valve lifter 6, adjuster bolt 13, valve stem 3*a* and valve 3, thereby opening the intake port 2. When the cam further rotates and the base circle 5*c* faces the shim 10, the valve 3 and the valve lifter 6 will rise under the force of the valve spring 21, closing the intake port 2.

While the valve 3 is repeatedly opened and closed, the engine temperature rises gradually, so that the distance between the center of the cam 5 and the valve seat 2*a* of the intake port 2 will increase due to thermal expansion.

The lengths of the valve 3 and the valve stem 3*a* will also increase due to thermal expansion. But since the valve 3 has a smaller thermal expansion coefficient than the cylinder head 1, a positive valve clearance is formed between the base circle 5*c* of the cam 5 and the top surface of the shim 10 of the valve lifter 6 while the valve 3 is closed, i.e. seated on the valve seat 2*a*. In this state, the adjuster bolt 13 will move downwardly while rotating under the force of the spring 15 to absorb the valve clearance.

When the engine is cut at high temperature and cools down gradually, the valve clearance between the valve lifter 6 and the base circle 5*c* of the cam 5 will change toward the negative side due to a difference in thermal expansion coefficient between the cylinder head 1 and the valve 3.

If the threaded hole 12 of the valve lifter 6 and the adjuster bolt 13 are in thread engagement with each other with no axial gap therebetween, the base circle 5*c* of the cam 5 will push down the valve lifter 6, thus keeping the valve 3 open.

In the embodiment, the axial gap δ between the threads of the threaded hole 12 and the adjuster bolt 13 absorbs any change in the valve clearance.

Suppose now that the distance L between the center of the cam 5 and the valve seat 2*a* is 100 mm. Aluminum and iron have thermal expansion coefficients of $23\times10^{-6}$ and $11\times10^{-6}$, respectively. Thus, if the engine is cut at 90° C. and cooled down to 0° C., the clearance C will be $$(23-11)\times10^{-6}\times100\times90=0.108$$

If the axial gap δ between the threads of the threaded hole 12 and the adjuster bolt 13 is between 0.1 and 0.5 mm, it can absorb the change in valve clearance C.

Since the axial gap δ is smaller than the height of the ramp 5*a* of the cam 5, the valve 3 is brought into contact with the valve seat 2*a* with the shim 10 of the valve lifter 6 in contact with the ramp 5*a*. Thus, the ramp prevents impulsive collision of the valve 3 against the valve seat 2*a*, allowing the valve to seat quietly.

According to this invention, the axial gap formed between the threads of the threaded shaft of the valve lifter and the adjuster bolt is smaller than the height of the ramp of the cam but large enough to absorb any change in valve clearance if a negative valve clearance is formed between the cam and the valve lifter due to change in temperature. Thus, even when the engine is cut at high temperature and cools down thereafter, the valve remains closed because it is not pushed down by the base circle of the cam. The valve thus always operates with high accuracy.

Since the maximum value of the axial gap is smaller than the height of the ramp of the cam, even if a positive valve clearance forms between the cam base circle and the valve lifter, the sum of such a valve clearance and the axial gap will never exceed the height of the ramp. Thus, the valve can be controlled reliably by the ramp of the cam in such a way that the valve will never collide impulsively against the valve seat. The valve can be seated quietly without making a noise.

Second Embodiment

Figure 4:
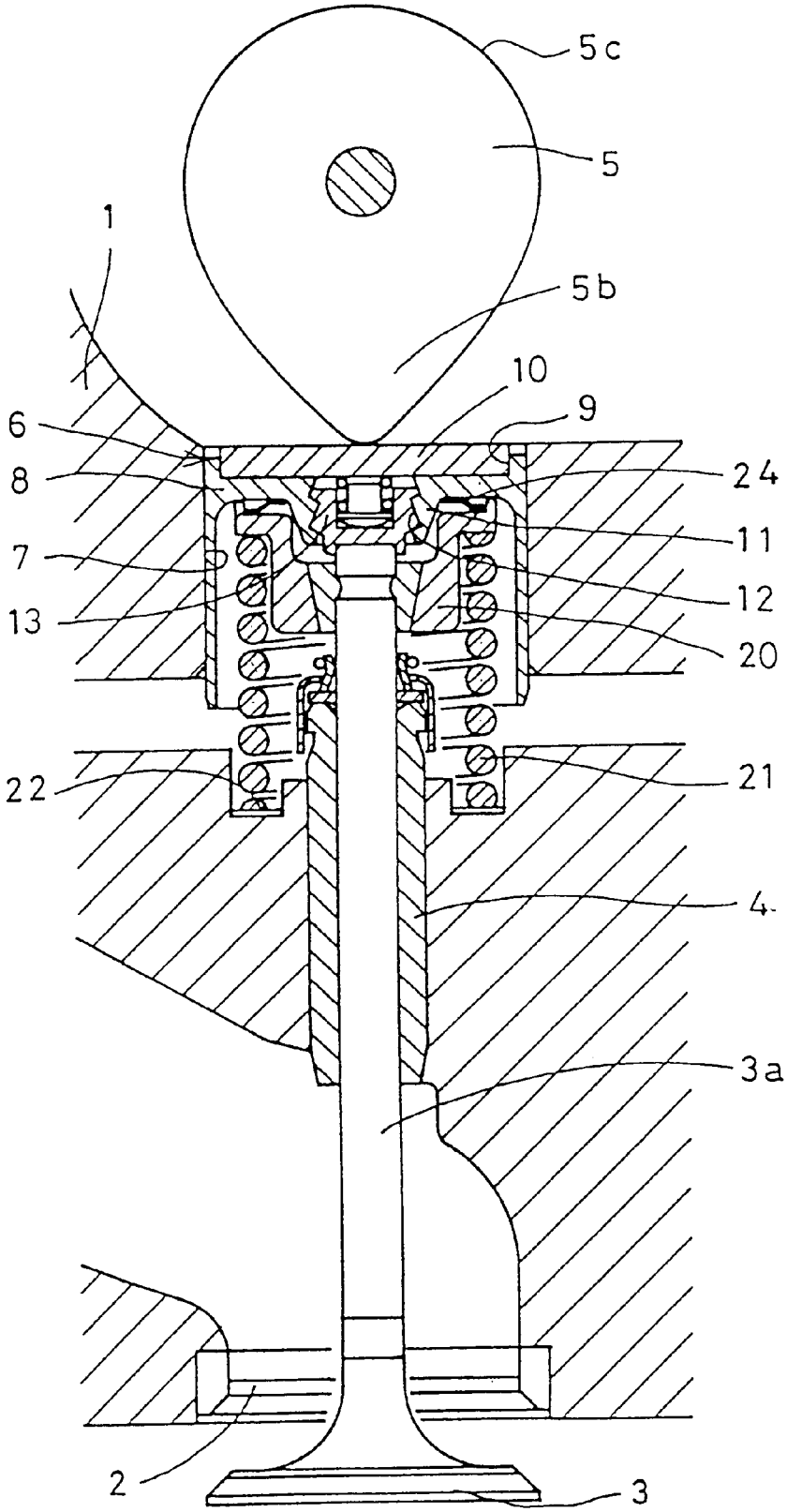
FIG. 4 is a vertical sectional side view of a direct valve drive device embodying this invention.
Figure 5:
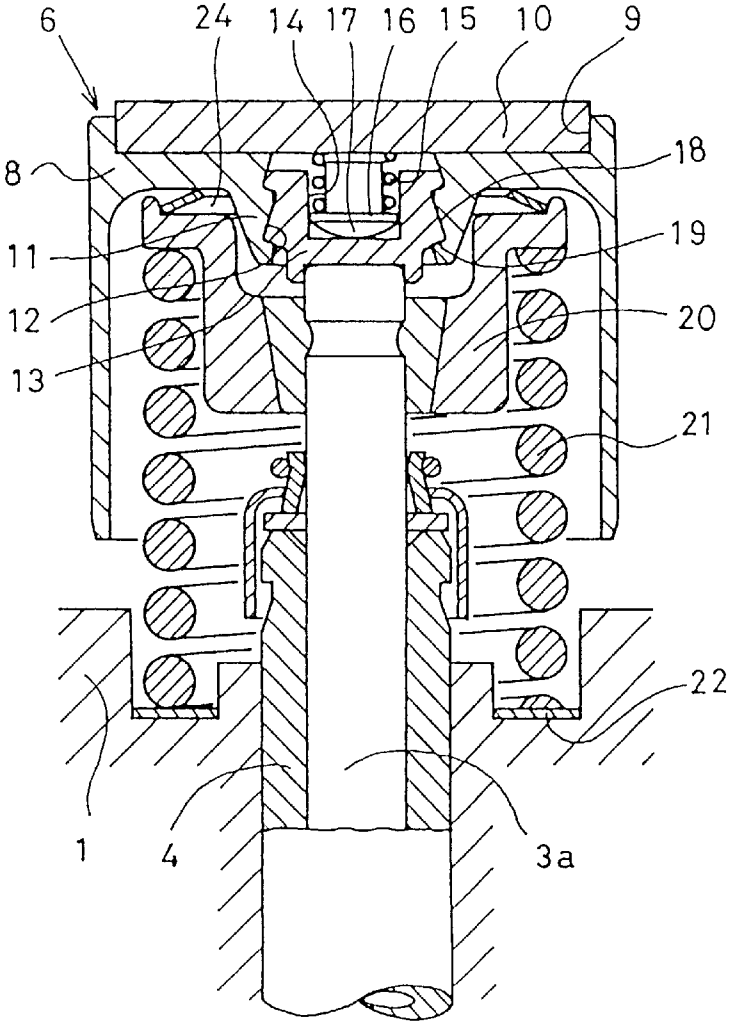
FIG. 5 is an enlarged sectional view of a portion of FIG. 4.

FIGS. 4 and 5 show a second embodiment of the direct valve drive device according to this invention. This embodiment differs from the direct valve drive device shown in FIG. 1 in that an elastic member 24 is mounted between the closed end of the valve lifter 6 and the spring retainer 20 to press the shim 10 of the valve lifter 6 against the cam 5 by the force of the elastic member 24.

Figure 6:
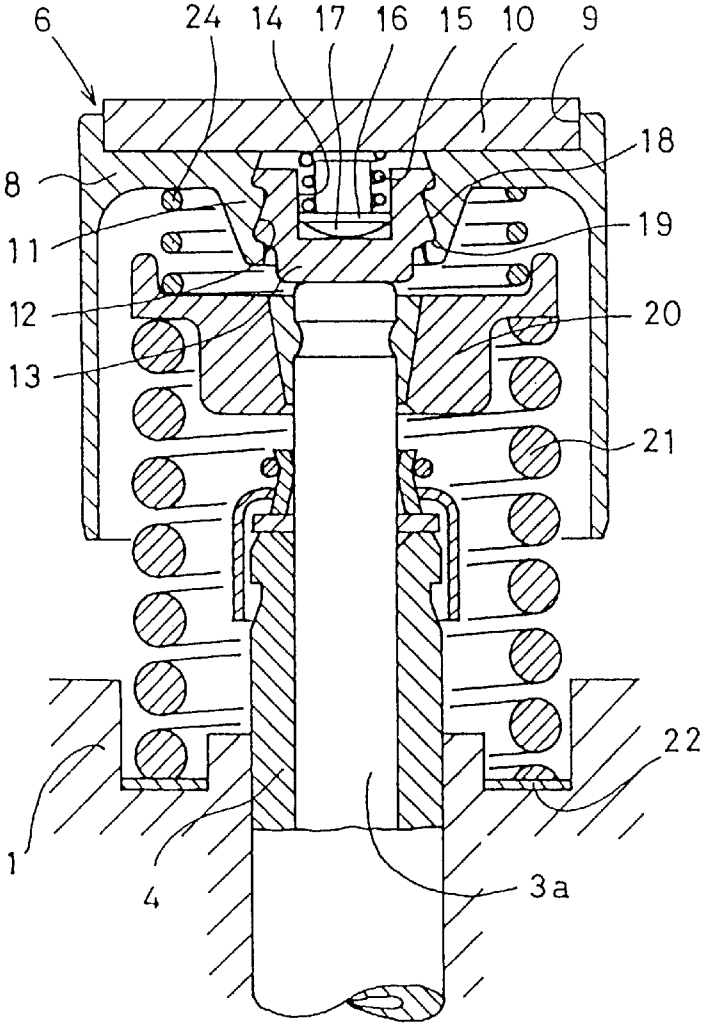
FIG. 6 is a sectional view showing a different elastic means from the one shown in FIG. 4.
Figure 7:
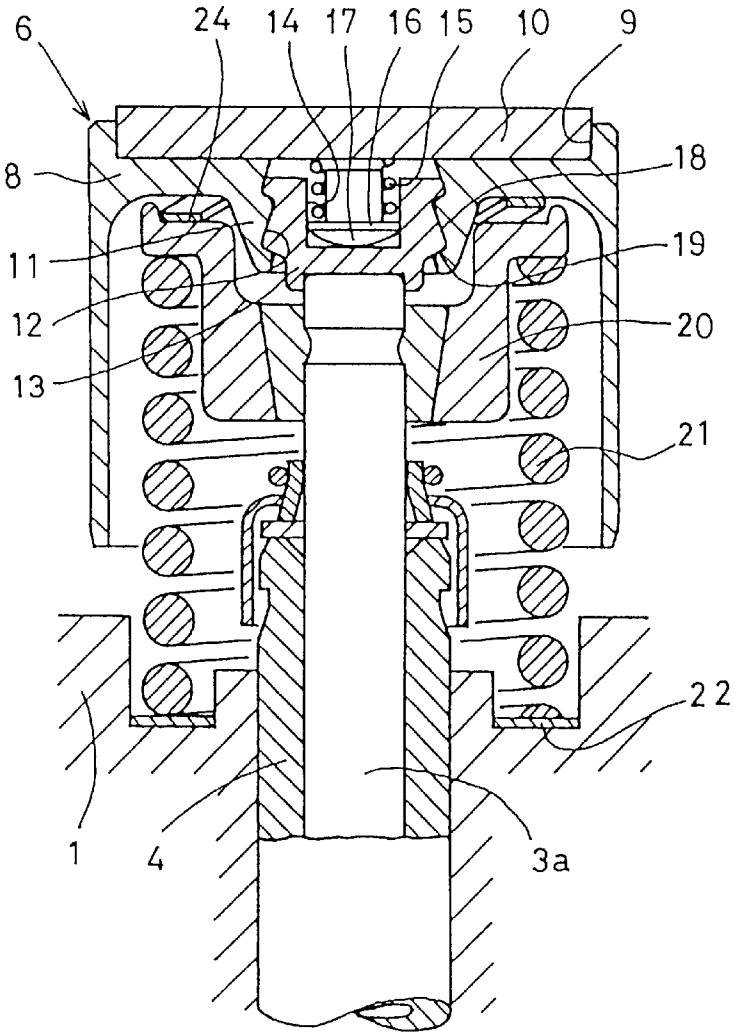
FIG. 7 is a sectional view showing a still different elastic means.

The elastic member 24 may be a disk spring shown in FIG. 5, a coil spring shown in FIG. 6, or a corrugated spring washer as shown in FIG. 7.

Figure 8:
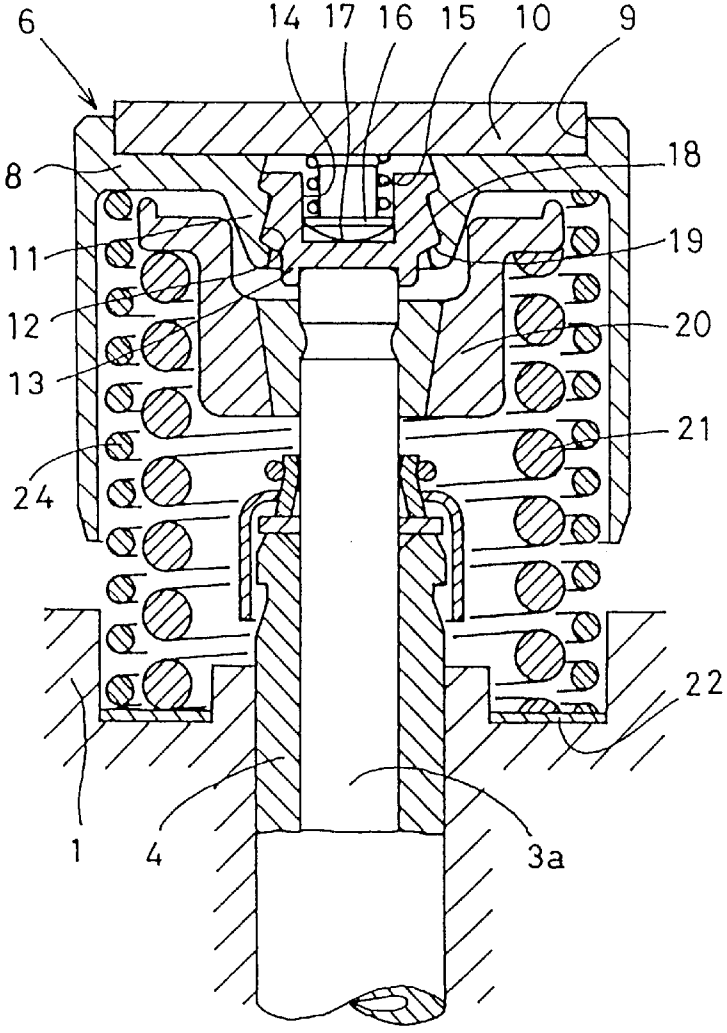
FIG. 8 is a sectional view of another direct valve drive device embodying the invention.

In the embodiments of FIGS. 5–7, an elastic member 24 is mounted between the closed end of the valve lifter 6 and the spring retainer 20 to press the valve lifter 6 against the cam 5. But as shown in FIG. 8, an elastic member 24 in the form of a coil spring may be mounted between the closed end of the valve lifter 6 and a spring bearing surface 22 of the cylinder head 1 to press the valve lifter 6 against the cam 5.

By providing the elastic member 24 to press the valve lifter 6 against the cam 5, the valve lifter 6 can be always kept in contact with the cam 5 with high reliability. This improves followability of the valve lifter 6 to the rotation of the cam 5 and thus prevents the formation of gaps between the base circle 5*b* of the cam 5 and the cam contact surface of the valve lifter 6 and between the top end of the valve stem 3*a* and the opposed portion of the adjuster bolt 13. The valve can thus be opened and closed with accuracy.

Third Embodiment

Figure 9:
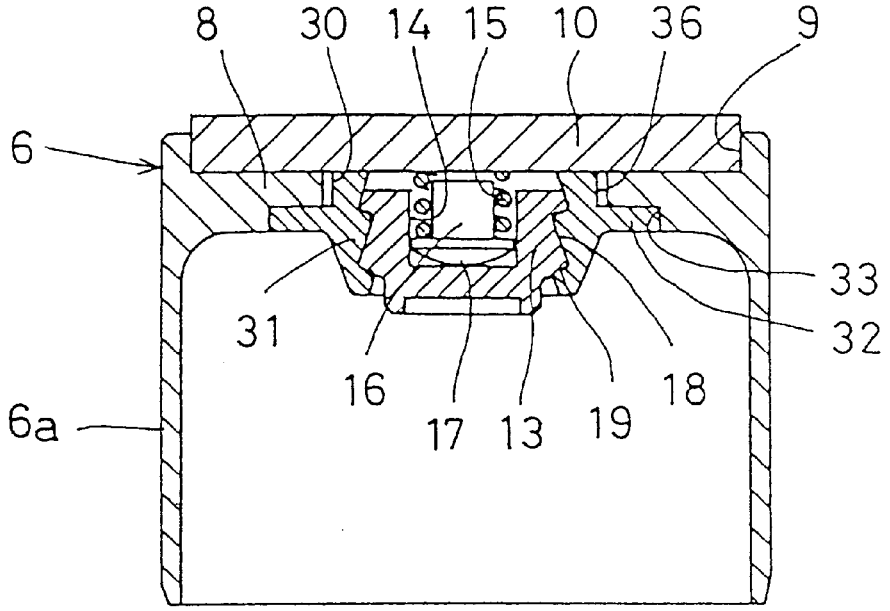
FIG. 9 is a vertical sectional front view of another embodiment of a valve lifter.
Figure 10:
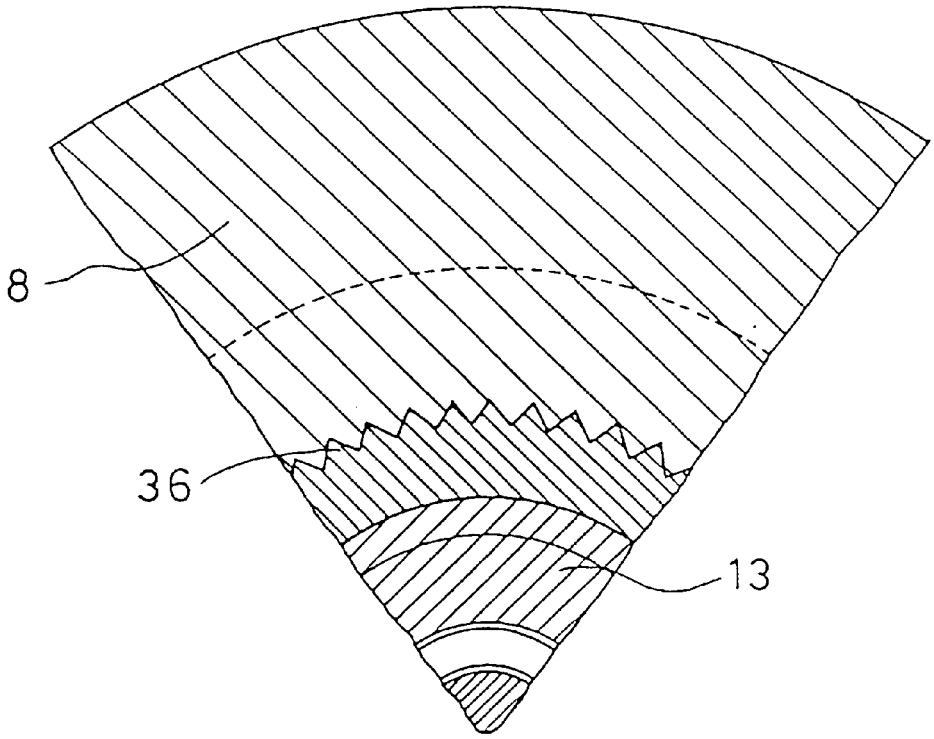
FIG. 10 is a sectional view of the threadedly engaging portion of the nut mounting hole and the nut member.

FIGS. 9 and 10 show another embodiment of the valve lifter 6 of the direct valve drive device. This valve lifter 6 has a cap-shaped lifter body 6*a* made from an aluminum alloy and formed with a nut mounting hole 30 extending vertically through its closed end. A nut member 31 made of a hard metal such as iron is received in the nut mounting hole 30. Serrations 36 are formed between their engaging surfaces to keep the nut member 31 nonrotatable.

Under the nut mounting hole 31, the lifter body 6*a* is formed with a recess 33 in which is received a flange 32 of the nut member 31. The nut member 31 is fixed by e.g. caulking the edge of the opening of the recess 33.

A shim 10 made of a hard metal such as iron fits in a recess 9 formed in the closed end of the lifter body 6*a*.

Since the lifter body 6*a* is made of an aluminum alloy and the shim 10 and the nut member 31 are made of a hard metal, the valve lifter is sufficiently lightweight and durable.

What is claimed is:

1. A direct valve drive device comprising a cam, a cylinder head, a valve having a valve stem, a cap-shaped valve lifter having a closed top and axially slidably mounted between said cam and said valve stem slidably supported by said cylinder head, a valve spring supported by a spring seat for biasing said valve stem in such a direction that said valve lifter is pressed against said cam, said valve lifter being formed with a threaded hole coaxial with said valve stem, and an adjuster bolt threaded into said threaded hole and spring-biased so as to be movable, while rotating, toward said valve stem, an axial gap being formed between threadedly engaging portions of said valve lifter and said adjuster bolt, said axial gap being smaller than the height of a ramp formed on said cam but large enough to absorb any difference in thermal expansion between said cylinder head and said valve.

2. A direct valve drive device as claimed in claim 1 wherein an elastic means is provided to press said valve lifter against said cam.

3. A direct valve drive device as claimed in claim 2 wherein said elastic means is mounted between a spring retainer and said closed top of said valve lifter.

4. A direct valve drive device as claimed in claim 2 wherein said elastic means is a disk spring.

5. A direct valve drive device as claimed in claim 2 wherein said elastic means is a coil spring.

6. A direct valve drive device as claimed in claim 2 wherein said elastic means is a corrugated spring washer.

7. A direct valve drive device as claimed in claim 2 wherein said elastic means is a coil spring arranged around and concentrically with said valve spring for biasing said closed top of said valve lifter.

8. A direct valve drive device as claimed in claim 1 wherein said valve lifter comprises a cap-shaped lifter body made from an aluminum alloy, said lifter body formed with a nut mounting hole extending vertically therethrough, a nut member made of a hard metal and nonrotatably received in said nut mounting hole, and a shim made of a hard metal and mounted on said closed top of said lifter body.

9. A valve lifter for use in the direct valve drive device as claimed in claim 8 wherein said nut member is nonrotatably retained in said vertical through hole by serrations.

10. A direct valve drive device as claimed in claim 2 wherein said valve lifter comprises a cap-shaped lifter body made from an aluminum alloy, said lifter body formed with a nut mounting hole extending vertically therethrough, a nut member made of a hard metal and nonrotatably received in said nut mounting hole, and a shim made of a hard metal and mounted on said closed top of said lifter body.

11. A direct valve drive device as claimed in claim 3 wherein said valve lifter comprises a cap-shaped lifter body made from an aluminum alloy, said lifter body formed with a nut mounting hole extending vertically therethrough, a nut member made of a hard metal and nonrotatably received in said nut mounting hole, and a shim made of a hard metal and mounted on said closed top of said lifter body.

12. A direct valve drive device as claimed in claim 4 wherein said valve lifter comprises a cap-shaped lifter body made from an aluminum alloy, said lifter body formed with a nut mounting hole extending vertically therethrough, a nut member made of a hard metal and nonrotatably received in said nut mounting hole, and a shim made of a hard metal and mounted on said closed top of said lifter body.

13. A direct valve drive device as claimed in claim 5 wherein said valve lifter comprises a cap-shaped lifter body made from an aluminum alloy, said lifter body formed with a nut mounting hole extending vertically therethrough, a nut member made of a hard metal and nonrotatably received in said nut mounting hole, and a shim made of a hard metal and mounted on said closed top of said lifter body.

14. A direct valve drive device as claimed in claim 6 wherein said valve lifter comprises a cap-shaped lifter body made from an aluminum alloy, said lifter body formed with a nut mounting hole extending vertically therethrough, a nut member made of a hard metal and nonrotatably received in said nut mounting hole, and a shim made of a hard metal and mounted on said closed top of said lifter body.

15. A direct valve drive device as claimed in claim 7 wherein said valve lifter comprises a cap-shaped lifter body made from an aluminum alloy, said lifter body formed with a nut mounting hole extending vertically therethrough, a nut member made of a hard metal and nonrotatably received in said nut mounting hole, and a shim made of a hard metal and mounted on said closed top of said lifter body.

* * * * *